US006024375A

United States Patent [19]

Johnson

[11] Patent Number: 6,024,375

[45] Date of Patent: Feb. 15, 2000

[54] QUICK ATTACHMENT/RELEASE BINDING

[76] Inventor: Gary E. Johnson, 22711 Western Ave., Torrance, Calif. 90501-4994

[21] Appl. No.: 09/090,206

[22] Filed: May 29, 1998

Related U.S. Application Data

[63] Continuation-in-part of application No. 08/744,290, Nov. 6, 1996, abandoned

[60] Provisional application No. 60/010,191, Jan. 18, 1996.

[51] Int. Cl.[7] ..... A63C 9/08

[52] U.S. Cl. ..... 280/601; 280/611; 280/633

[58] Field of Search ..... 280/809, 607, 280/14.2, 611, 613, 616, 617, 618, 625, 633, 634; 441/70, 68

[56] References Cited

U.S. PATENT DOCUMENTS

| | | | |
|---|---|---|---|
| 1,593,937 | 7/1926 | Hall | 280/618 |
| 3,813,109 | 5/1974 | Salomon | 280/618 |
| 4,273,354 | 6/1981 | George | 280/614 |
| 4,284,292 | 8/1981 | Faulin | 280/618 |
| 4,920,665 | 5/1990 | Pack et al. | 280/613 |
| 5,318,320 | 6/1994 | Ramer | 280/614 |
| 5,758,895 | 6/1998 | Bumgarner | 280/607 |
| 5,941,553 | 8/1999 | Korman | 280/613 |

*Primary Examiner*—Lanna Mai
*Assistant Examiner*—Hau V Phan
*Attorney, Agent, or Firm*—John E. Halamka

[57] ABSTRACT

Attachment for a binding (1) having straps and fitting a user's boot, the binding attached to a snow gliding or wake boarding device. Upon detachment of one end of each strap of the binding, the ends are attached to a spanning bar (11). A closing lever (10) is mounted to the spanning bar (12,14) to provide a preselected mechanical advantage. A front clip (30) having a niche rod (32) is mounted near the toe end of the binding (33), and a rear clip (20) having a latch (26) is mounted near the heel end. The closing lever is engaged with the niche rod (32) and then with the latch (26), moving the spanning bar downward and tightening the straps around the boot. The first insertion of the boot requires adjustment of the strap tension; subsequent insertions do not require further adjustment. The closing lever (10) is releasable from the latch, loosening the straps for boot removal. The latch may be fitted with a cable release and a safety lock (28) to prevent disengagement of the closing lever from the latch.

19 Claims, 4 Drawing Sheets

QUICK ATTACHMENT/RELEASE BINDING

This application is based upon the Provisional Patent filed Jan. 18, 1996 as Ser. No. 60/010,191. This application is a continuation in part of U.S. patent application Ser. No. 08/744,290, filed Nov. 6, 1996 which is abandoned upon the acceptance of this CIP for filing.

BACKGROUND OF THE INVENTION

1. Field of the Invention

This invention relates to the art of removably attaching at least one boot worn by a user to a snow gliding device or wake boarding device and more particularly providing quick on and off attachment of the boot of the user to the binding mounted on the snow gliding device by means of a single latchable lever. The lever is configured to provide a mechanical advantage to allow the closure of straps over the boot whereby the straps secure the boot within the binding. With the mechanical advantage the lever may be closed with one hand, even if the hand is gloved.

2. Description of the Prior Art

The art of binding a boot to a snow gliding device has a long history and many variations. As the snow gliding device evolved from cross-country skis to downhill skis to snowboards, the bindings have evolved to accommodate each device, each change in boot technology and the demands in performance, ease of use and safety. The teaching herein of a pivoting locking bar with a mechanical advantage may also be used for the binding of a wake gliding device.

Disengagement and reengagement of at least one boot with the snowboard is required to utilize a lift. The board usually remains attached to one foot while the other foot is disengaged to ease the boarding and dismount from a chair lift.

Currently there are over 300 different configurations of a binding into which the user places a boot for secure attachment to a snowboard. There are also numerous configurations of a binding for a wakeboard. Most of the bindings can be lumped into a group referred to as "standard bindings" consisting of a foot bed attachable directly to the snowboard or wake board and at least a toe strap and an instep strap to secure the user's boot within the foot bed. Each time the user wishes to remove a boot from the binding, all straps must be uncoupled. Upon wishing to remount the board, the user must reengage the straps and adjust the tension to secure the boot within the foot bed of the binding.

The current art teaches the use of straps with buckles. Some of the buckles incorporate ratchets whereby the strap, having a tooth textured surface, may be drawn tight through the buckle by pumping the ratchet. Releasing the strap to catch a lift and then reengaging the strap after disembarking the lift may be difficult with heavy gloves and build-up of ice on the boot, strap or buckle. When the snow is deep, it is sometimes difficult to locate the ratchet.

Should the strap become disengaged from the buckle, it is most difficult to reengage it under the usual conditions of cold, wet environment of snow boarding.

Solutions to eliminate the straps have taught the use of a steel plate mounted to the board and engageable by a step in connector mounted to the sole of the user's boot. This type of boot requires a stiff sole and reduces the maneuverability of the boot. The step in connector of the boot or plate on the board may become packed with ice so that the connector fails to completely engage the connector to the plate.

Further, because the user must step into and lock this device, if the board is resting on soft snow, the force to lock in this mounting tends to drive the board into the snow without engagement of the connector onto the plate.

A proposed solution to the problem is attempted in U.S. Pat. No. 5,143,396 ('396). This solution teaches the use of a huge, heavy, special built cradle for the boot. '396 further teaches the use of two specially fabricated straps which only adjust by removing the strap end engaged remote from the closing bar and reengaging the special strap at the next set of holes until hopefully, by experimentation, a snug fit over the boot is achieved when the bar is closed. '396 attempts to teach the use of a latch device (page 5, line 40 '(how this occurs is to be described)'. Unfortunately '396 does not describe how the handle 86 and fastening means 36 function. The only teaching is that pressing down on the handle 86 will release the bar. According to this teaching, this release may then occur at some time not desired by the user. Further, according to this teaching the "hinged" portion of the bar is at one end and the handle 86 is at the other end with the straps mounted between the "hinged" end and the handle 86. No mechanical advantage is taught or even suggested by '396 to ease the engagement of the handle 86 with the fastening means 36. Only direct pressure to force the straps over the boot, which may be enlarged with ice, snow, and moisture, is utilized by '396.

'396 does not teach or suggest that it may be adapted to any other binding than its own specially built binding with the inherent limitation as to the kind of boot which functions with that binding.

Thus, there has long been a need for an arrangement which allows the user to easily engage and disengage a boot to a snowboard or wake board device.

It is desired that the arrangement allow a full range of adjustment of the tension of the straps to accommodate the user's boot.

It is further desired that the strap tension adjustment be required only initially and not again especially after disengagement and reengagement of the boot to the board.

It is further desired that the arrangement be able to be activated and deactivated by a user even wearing thick gloves in a cold environment. It is preferred that the engagement or disengagement be accomplished, without requiring great strength. It is desired that this be one easy stroke like movement yet is securely engaged so as to not inadvertently disengage.

It is further desired that the arrangement engagement not be adversely affected by a build up of ice on the boot, binding, straps or board.

It is further desired that the engagement not require strong pressure which would drive the board into soft snow.

It is desired that a simple latching or unlatching movement engage and disengage the arrangement holding the boot to the binding.

It is desired that this movement be accomplished with the placement of a simple bar which can be engaged even if the user is wearing thick gloves.

It is further desired that the closing incorporate a mechanical advantage to reduce the force required to engage the latch within a catch.

It is further desired that the arrangement adapt to the user's boot, soft or hard, without requiring any special connector to be mounted to the boot.

SUMMARY OF THE INVENTION

Accordingly, it is an object of the present invention to provide a quick on and immediate release of the boot of the user from a binding mounted on a snowboard.

It is an object of the present invention to provide an improved arrangement which allows the user to initially adjust the tension on the straps which hold the boot to the binding but thereafter not require any adjustment to the tension even after disengagement of the boot from the binding.

It is another object of the present invention to provide a method of engagement and disengagement of the boot from the binding by a single stroke like movement of a lever workable by a user even wearing thick gloves in a cold environment. The engagement must be such as to not be inadvertently disengaged.

It is yet another object of the present invention to provide a latch arrangement which is not adversely affected by a build up of ice on the latch, boot, strap, binding or board and be engageable without strong pressure which may drive a board into soft snow. The latch should incorporate a preselected mechanical advantage to place the closing pressure in an acceptable range.

It is yet another object of the present invention to be easily mountable on any "standard binding" and accept any boot which may be currently owned by the user.

The above and other objects of the present invention are achieved, according to a preferred enbodiment thereof, by providing an improved front clip and rear clip mountable to the user's binding. A spanning bar is engageble with the straps, spans the straps and is pulled taut by a closing lever which snaps into place with the ease of closing a door latch. The closing lever is attached to the spanning bar at a preselected position to provide a mechanical advantage and may be locked into place within the rear clip. When latched and unlocked, the rear clip is designed for quick release of the closing lever. Upon release, the closing lever is positioned for quick reengagement within the front and rear clips.

In the preferred enbodiment, the application of a spanning bar to span the straps and the mounting of an end of each strap to the spanning bar provides a quick securing of the user's boot under the straps and a quick release of the boot when the spanning bar is disengaged. The clips being mountable to the existing binding of the user allows the present invention to adapt to the boot, board, and binding owned by the user, be the boot soft or hard, without requiring any special clips to be attached to the boot or board.

BRIEF DESCRIPTION OF THE DRAWINGS

The above and other embodiments of the present invention may be more fully understood from the following detailed description, taken together with the accompanying drawings, wherein similar reference characters refer to similar elements throughout, and in which.

DESCRIPTION OF A PREFERRED EMBODIMENT

Figure 1:
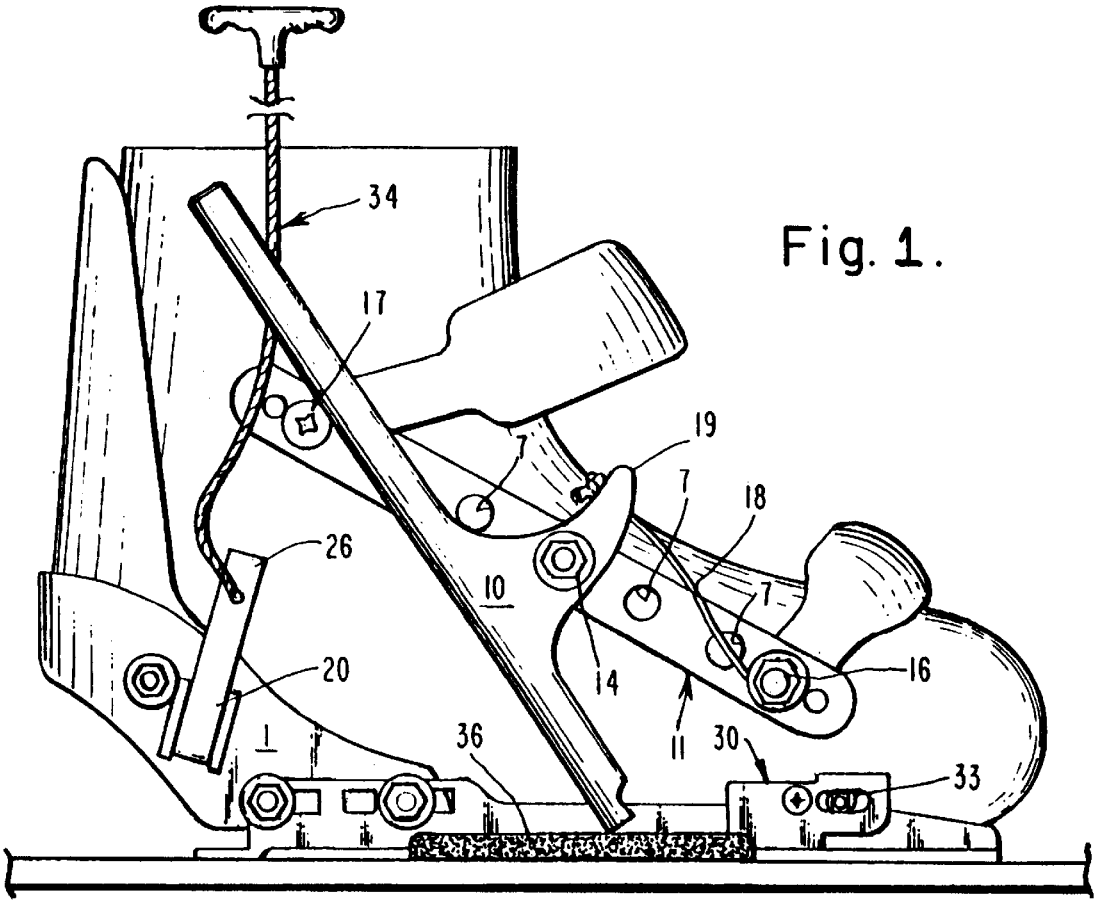
FIG. 1 is a plane side view of a boot engaged in a standard binding by the invention.

Referring now to the drawing, FIG. 1 shows the boot of the user engaged in a standard binding 1 by the latchable, releasable arrangement according to the invention.

The overall function of the invention herein is best understood from FIG. 1. The boot of the user is held within a binding device by a set of straps. The straps are initially adjusted for the desired level of snugness after the closing lever 10 is engaged within the front clip 30 and the rear clip 20. This action lowers the spanning bar 11 into position. To extricate the boot from the binding 1, the user presses on the upper portion of clip 20 to release the closing lever 10. This allows the disengagement of the closing lever 10 from the front clip 30 as well allowing the spanning bar 11 to move. As the ends of the set of straps are attached to the spanning bar 11, the tension on the straps to hold the boot within the binding 1 is released thereby allowing the boot to be extracted from the binding 1.

Most straps either come with or may be fitted with buckles which have a ratchet adjustment for tightening the strap. The straps are mounted with one end on the binding 1 and the other end on the spanning bar 11, one strap positioned to cross over the toe of the user's boot, after initially engaging the closing lever 10 into the clips, the straps may be adjusted by operating the ratchet thereby drawing the strap into and through the buckle to achieve a comfortably snug configuration of the user's boot within the binding 1.

As the straps are released sufficiently to allow the boot to be removed, the straps are likewise sufficiently loose to allow the boot to be reinserted. Thus, upon engaging the closing lever 10 within the front clip 30 and then the rear clip 20, the spanning bar 11 re-initiates the preset tension of the straps to hold the boot within the binding 1. No further adjustment should be necessary.

In the prior art, the user had to release the buckles on the straps in order to remove the boot from the binding. To remount the boot to the binding, the user had to reengage the straps into the buckles and adjust the tension to the desired level. This required two hands and may require the removal of any gloves in order to accomplish the function.

FIG. 1 illustrates that the spanning bar 11 is attached to the closing lever 10 at a preselected position between the straps. Further, the closing lever 10 is fabricated with a wing tip 19 within which is selected the point to attach the spanning bar 11 to the closing lever 10. These positions are selected to give at least a five to one mechanical advantage to the engagement of the boot within the straps. The front clip 30 acts as a fulcrum so that for every five inches of travel of the end of the closing lever 10 remote from the front clip 30, the spanning bar 11 is moved down one inch.

With the present invention, at the mechanical advantage provided, the insertion, locking, initial adjustment, release, re-insertion, and re-locking may be accomplished with only one hand and that hand may be protected with a glove.

The units are fabricated of a preselected material, chosen to be lightweight, strong and able to function in a cold, wet environment. A lightweight urethane is used in the preferred embodiment for the closing bar 10 and rear clip 20 latch. Both of these items may be strengthened by containing a reinforcement bar of metal or wound carbon filament. The spanning bar 11 may be fabricated of aluminum due to its light weight and strength characteristics. The weight of the spanning bar 11 may be further reduced by drilling holes of selected size, number and placement to safely reduce the weight without weakening the structural integrity of the spanning bar 11 to hold the straps in place under the expected stress of snowboarding. Bending of the spanning bar 11 under stress of normal range of use should be avoided.

A fourth element may be added. As the release of the closing lever 10 and spanning bar 11 may result in the contact of these items with the upper surface of the board, this contact point may become worn, pitted, or damaged. A protective pad may be mounted on the board in a position to protect a preselected, limited surface area of the board from contact with these items.

Note that when the closing lever 10 is detached from the rear latch 20, the bit of shock cord 18 connecting the closing lever 10 and spanning bar 11 holds the closing lever 10 in a vertical position for easy location and reengagement with the clips 30 and 20 by the user.

There are only three main items comprising this invention. The items are designed to be attached to any off the shelf, standard binding, and allow the adjustment of the tension of the unit to be adjusted for containment of the user's shoes into the binding. No special binding or shoes are required. As there are over 300 different bindings and an equal number of soft-shoes and hard boots, the object of this invention to be universally adaptable to whatever equipment is currently owned by the user is met.

The three units are designed to be usable on either the right or the left side of the binding. The location, right, left, inside, or outside is a user preference.

The standard binding owned by the user is assumed to be mountable on the user's board. The individual units taught herein are mounted directly to the user's binding. Every effort was made to make the mounting holes or slots compatible with as many pre-drilled holes on the bindings as possible. However, there may be some bindings which require drilling to establish new mounting holes or enlarge existing mounting holes to allow attachment of the units.

The front clip 30 is shaped to guide one end of the closing lever 10 into position, the rear clip 20 holds the closing lever 10 latched and capable of immediate release. The movement of the closing lever 10 lowers the spanning bar 11 to tighten the straps. As discussed above, the configuration and attachment of the spanning bar 11 and closing lever 10 provides a mechanical advantage to the closing function.

Figure 2:
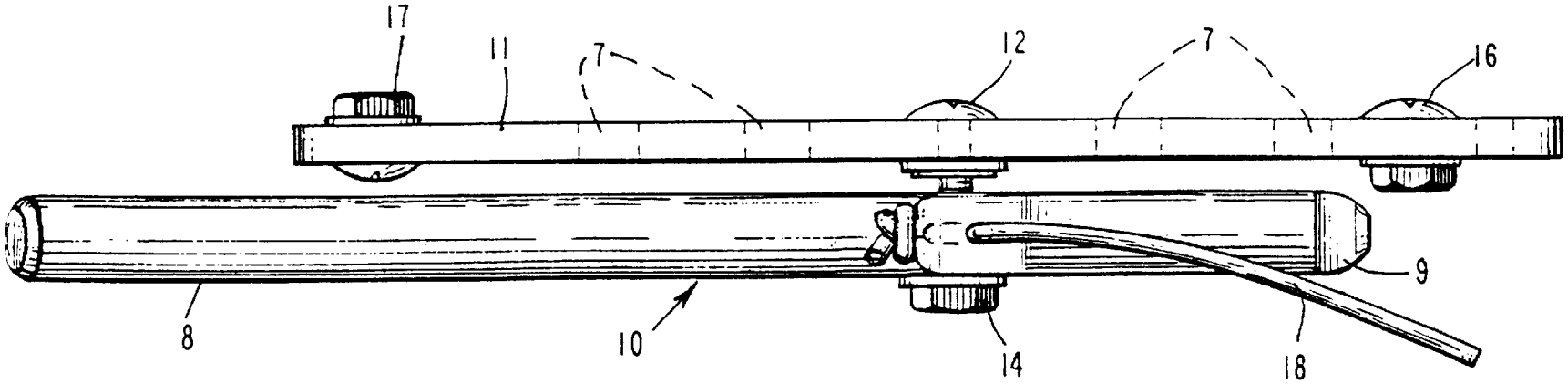
FIG. 2 is a top view of the spanning bar and closing lever in the latched position, not mounted on the binding.
Figure 3:
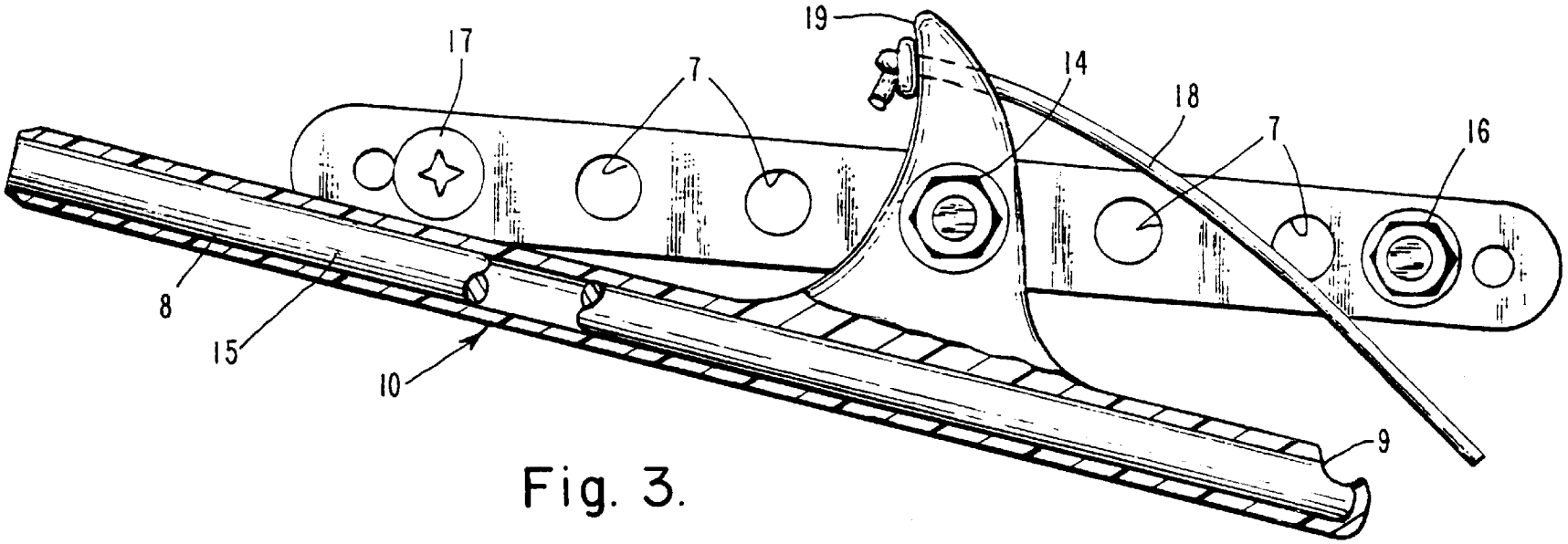
FIG. 3 is side view of the spanning bar and closing lever in the latched position, not mounted on the binding.
Figure 7:
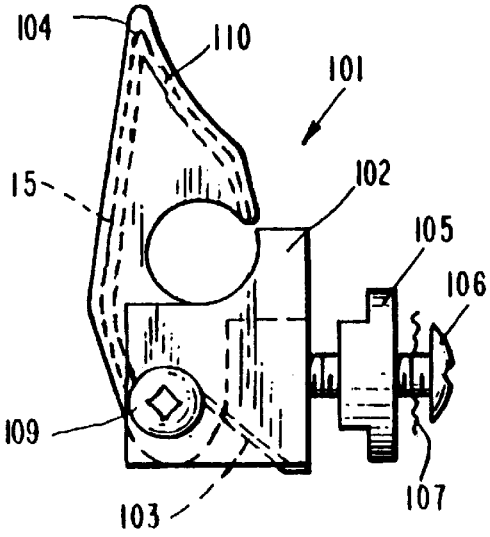
FIG. 7 is a front end view of the rear clip.
Figure 8:
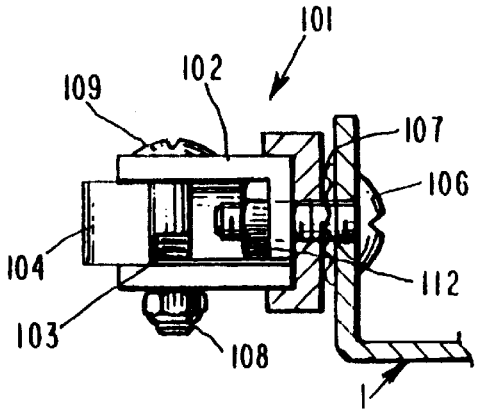
FIG. 8 is a bottom view of the rear clip mounted to the binding.
Figure 9:
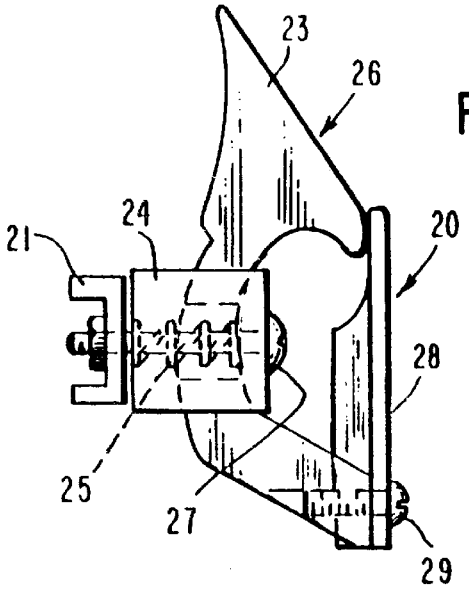
FIG. 9 is a side view of another embodiment of the rear clip.
Figure 10:
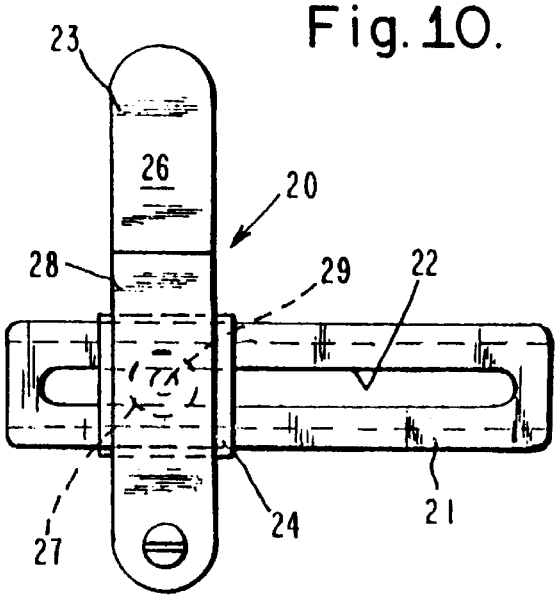
FIG. 10 is a back view of another embodiment of the rear clip.
Figure 11:
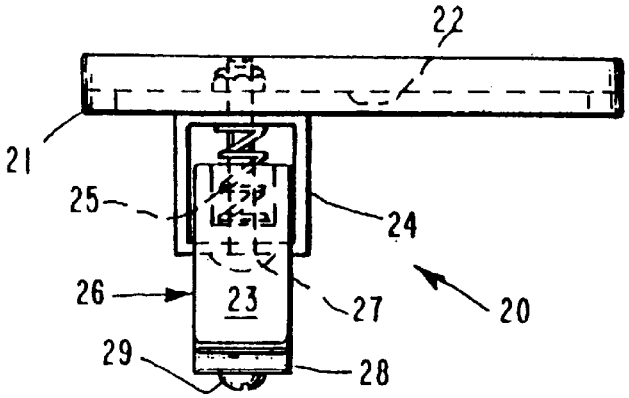
FIG. 11 is a top view bottom view of another embodiment of the rear clip.

The individual units and their function are shown in FIGS. 2 through 8 with another embodiment of the rear clip shown in FIGS. 9, 10 and 11 wherein:

FIGS. 2 and 3 depict the arrangement of the spanning bar 11 and closing lever generally designated 10. The closing lever 10 is unitarily fabricated of a generally tubular body 8 portion and a wing tip 19 portion. The tubular body 8 is of a diameter to be engageble with the front clip 30. The tubular body 8 may be generally straight but may be fabricated with a slight curved shaped to conform to the general rounded shape of the binding. The spanning bar 11 and closing lever 10 are pivotally joined, at preselected position to provide a preselected mechanical advantage, by a bolt 12 and lock nut 14. They are spaced apart with a washer 13 to be freely rotatable around the axis of the bolt 12. One end of the shock cord 18 may be retained by the front strap mount 16 attaching the front strap to the spanning bar 11. The wing tip 19 accepts the other end of the shock cord 18 to be retained therein by a knot. When unlatched, the short shock cord 18 pulls the closing lever 10 into a vertical position, making the closing lever 10 easy for the user to locate. The remote ends of the spanning bar 11 contain front strap mounts 16 and rear strap mounts 17 to which at least two of the standard binding straps are attached by one end after removal of these ends from the standard binding. The other end of each strap remains mounted to the standard binding.

As the closing lever 10 is put in place, it pulls the spanning bar 11 down toward the binding, with a preselected mechanical advantage, thereby tightening the straps attached to the spanning bar 11 over the user's boot.

The end of the tubular body 8 is formed with a niche 9 which is engageble with the front clip 30 and acts as fulcrum point to exert pressure on the spanning bar 11 and straps for latching the end of the closing lever 10 remote from the niche 9 into the rear clip 20 thereby securing the boot into the binding.

The closing lever 10 may need to be bent or fabricated in a curve to accommodate the curvature, front to back, of some standard bindings in order to allow the closing lever 10 to engage both the front clip 30 and rear clip 20.

The spanning bar 11 may have a plurality of holes 7 drilled to remove material to make the bar 11 lighter. The location and number of holes are preselected to not degrade the structural integrity of the spanning bar 11.

Figure 5:
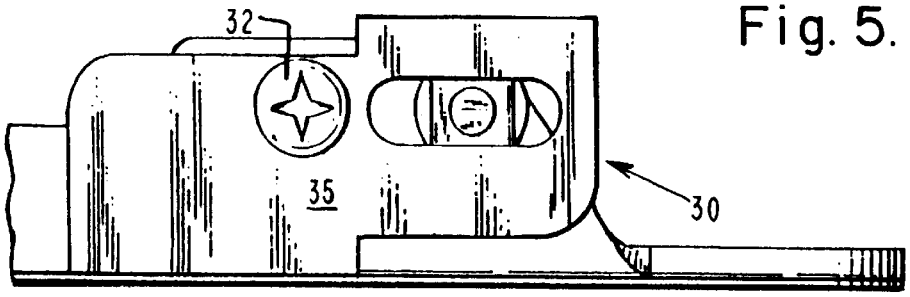
FIG. 5 is a side view of the front clip mounted to the binding.
Figure 6:
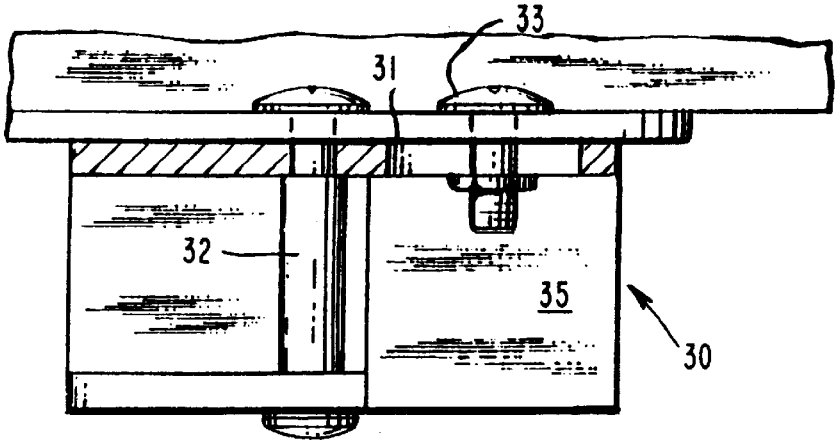
FIG. 6 is a top view of the front clip mounted to the binding.
Figure 4:
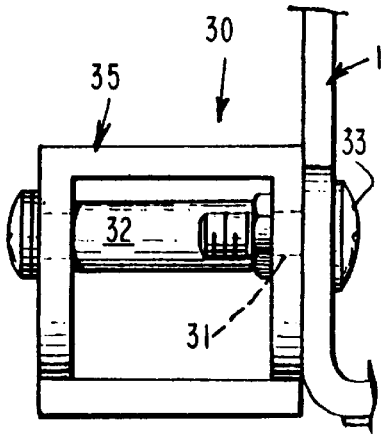
FIG. 4 is a front end view of the front clip mounted to the binding.

FIGS. 4, 5 and 6 show the detail of the front clip generally designated 30. The front clip 30 is fabricated of a generally box shaped niche locking bar support 35 in which is mounted a niche locking bar 32. The locking bar 32 is located to allow the tubular body 8 to be inserted within the bar support 35 in a position whereby the niche 9 engages the niche locking bar 32. An adjustment slot 31 is fabricated in the side of the front clip 30 to allow the front clip 30 to be mounted on the binding by means of a bolt and lock nut 33 and the niche locking bar 32. The length and placement of the adjustment slot 31 is selected to be compatible with most predrilled holes in standard bindings. The slot 31 is elongated to allow adjustment in the positioning of the front bracket to accommodate shorter or longer standard bindings.

FIGS. 7 and 8 show the detail of the rear clip generally designated 101. This rear latch arrangement 101 is assembled of a rear latch support 102 on which is pivotally mounted a rear latch 104 by means of the rear latch mounting bolt 109 and a lock nut 108. A rear latch spring 103 is incorporated within the rear latch 104 and mounted on the rear latch mounting bolt 109 to urge the rear latch 104 to a closed position over the closing lever 10. The rear latch-mounting bracket may be mounted to the binding with a single rear latch support mounting bolt 106. To prevent twisting, a lock washer 107 may be mounted on the bolt 106, secured to the binding by lock nut 112. A further aid to prevent twisting is to use a rear latch-mounting bracket 105 which wraps around the rear latch support 102. The mounting bracket 105 is fabricated of plastic to better engage the locking washer 107. The mounting of the rear latch arrangement 101 is with the latch 104 hook toward the binding. The hook 104 is formed with a sloping face 110 which pushes back the hook 104 against the spring 103 while the closing lever 10 is pushed down the sloping face 110 to allow the closing lever 10 to be engaged within the rear latch arrangement 101 when the spring 103 urges the rear latch 104 closed over the closing lever 10.

Another embodiment of the rear latch generally designated 20 is illustrated in FIGS. 9, 10 and 11. The rear latch

20 is fabricated of a generally box shaped latch support 24 within which the latch 23 is spring 25 loaded by assembling the latch 23 and spring 25 within the latch support 24 with a spring mount bolt 27. The spring mounting allows the latch 23 to move rearward toward the rear bracket 21 when the closing lever 10 is pushed down the sloping face 26 until the closing lever 10 is engaged within the latch 23. Simple pressure by the user on the sloping face 26 moves the latch 23 rearward enough to release the closing lever 10 from the latch 23.

The spring mount bolt 27 also mounts the latch support 24 to the rear bracket 21 with a lock nut to allow vertical positioning of the latch 23. The rear bracket 21 is formed with an adjustment slot 22 to accommodate mounting of the rear bracket 21 to the user's binding by any available predrilled holes formed in the binding.

As the usefulness of this invention becomes apparent, some binding manufacturers may form the front and rear of the binding to accept the front clip 30 and rear clip 20 as taught by this invention without the need of a rear bracket 21.

The latch 23 may accommodate the mounting of a safety lock 28 with mounting screw 29. Once the closing lever 10 is engaged within the latch 23, the safety lock 28 may be turned vertical to securely hold the closing lever 10 within the latch 23 until the safety lock 28 is rotated to a position to allow the disengagement of the closing lever 10 from the latch 23. This safety lock 28 arrangement avoids any uncontrolled or accidental release of the user's boot from the binding should the face 26 be inadvertently pushed rearward enough to disengage the closing lever 10 from the latch 23.

In another embodiment incorporated in FIG. 1, a cable release 34 having a handle 111 may be incorporated whereby the end of the cable remote from the handle 111 is attached to the face 26 of the latch. The handle 111 may be mountable so as to be accessible for the user to pull thereby moving the face 26 of the latch to a position to release the closing lever 10 from the latch.

Since certain changes may be made in the above apparatus without departing from the scope of the invention herein involved, it is intended that all matter contained in the above description, as shown in the accompanying drawings, shall be interpreted in an illustrative, and not a limiting sense.

What is claimed is:

1. A binding arrangement for repeatable quick attachment and instant release, under user selection, of a boot worn by a user, said boot having a heel and a toe portion, from being secured within a binding by straps attached by one end to said binding which is mounted on a snow gliding or wake boarding device, the tension of said straps first being initially adjusted to comfortably secure said boot within said binding, said binding arrangement comprising, in combination;

a front clip mountable at a preselected position of said binding near the toe portion of said boot;

a rear clip having a releasable latch mounted near the heel portion of said boot;

a spanning bar fabricated to allow one end of each of said straps remote from the end attached to said binding to be attached thereto;

a closing lever of a preselected size and shape mounted to said spanning bar, one end of said closing lever having a niche engagable with said front clip whereby upon the engagement of said closing lever into said front clip and latching a portion of said closing lever remote from said niche within said rear clip, said spanning bar is positioned to enclose said boot within said binding with said straps.

2. The arrangement defined in claim 1 wherein the mounting of said closing lever to said spanning bar is at a preselected position to give a preselected mechanical advantage to the positioning of said spanning bar upon the engagement of said closing lever with said clips.

3. The arrangement defined in claim 1 wherein;

a preselected portion of said closing lever is reinforced.

4. The arrangement defined in claim 1 wherein;

a preselected portion of said latch is reinforced.

5. The arrangement defined in claim 1 wherein;

reducing the weight of said spanning bar by removing preselected portions of said spanning bar without decreasing the structural integrity of said spanning bar which may allow said spanning bar to be permanently misshapen during normal use.

6. The arrangement defined in claim 1 wherein;

said closing lever is rotatably attached to said spanning bar, a preselected length of shock cord having a first end and a second end is attached to said closing lever by said first end and attached to said spanning bar by said second end whereby, upon release of said closing lever from said latch, said shock cord holds said closing lever essentially vertical to said spanning bar thereby rendering said closing lever easily locatable by the user to reengage said closing lever within said front and rear clips.

7. The arrangement defined in claim 1 wherein said front clip further comprises:

a niche bar support;

a niche bar mounted at a position within said support to accept said niche of said closing lever; and, a front adaptive bracket whereby said niche bar support may be mounted to a preselected position on said binding.

8. The arrangement defined in claim 7 wherein said front adaptive bracket further comprises:

first walls forming a preselected shaped slot whereby said front adaptive bracket may be mounted on said binding at a position of existing mounting holes preformed in said binding.

9. The arrangement defined in claim 1 wherein said rear clip further comprises:

a latch having a face of a preselected shape;

a latch support;

a spring having a first end and a second end, said latch being mounted to said first end of said spring and both latch and spring mounted within said latch support by attaching said second end of said spring to said latch support thereby allowing movement of said latch within said latch support and loading of said spring upon engagement of said closing lever with said face, said movement being in a direction to allow said closing lever to become engaged within said latch and retained therein by said spring loading; and, a rear adaptive bracket, which provides said mounting of said rear clip near the heel portion of said boot, mounted to said latch support whereby said latch mounted within said latch support may be positioned to be engagable by said closing lever and upon the condition of the user pressing on said face, said spring loaded latch moves to a position to release said closing lever from said latch.

10. The arrangement defined in claim 9 wherein said rear adaptive bracket further comprises:

first walls forming a slot whereby said rear adaptive bracket may be mounted on said binding at a position of existing mounting holes preformed in said binding.

11. The arrangement defined in claim 9 wherein said rear clip further comprises:

a safety lock rotatably mounted on said latch whereby, under the condition of said closing lever engaged within said latch, the user may rotate said safety lock to a position to secure said closing lever within said latch even upon movement of said face until said safety lock is rotated to a position which allows said closing lever to disengage from said latch upon the movement of said face by the user.

12. The arrangement defined in claim 9 further comprising:

a cable attached to said face and accessible to said user whereby exerting force on said cable remote from said face causes said latch to move within said latch support to a position whereby said closing lever is released from said latch.

13. The arrangement defined in claim 1 wherein said binding is formed with mounting brackets upon which said front clip and said rear clip may be directly mounted without requiring special adaptive brackets.

14. The arrangement defined in claim 1 further comprising;

a protective pad of a preselected shape mounted on said snow gliding device at a position to protect the surface of said snow gliding device from contact with at least said spanning bar and said closing lever.

15. The arrangement defined in claim 1 wherein said rear clip further comprises:

a latch having a face of a preselected shape;

a latch support;

a spring mounted within said latch support whereby said latch may be moved upon engagement of said closing lever and is urged to close over said closing lever allowing said closing lever to become engaged within said latch; and, a rear latch mounting bracket mountable to said latch support whereby said latch may be mounted to said binding in a position to be engagable by said closing lever after which, upon the condition of the user pressing on said face, said spring loaded latch moves to a position to release said closing lever from said latch.

16. The arrangement defined in claim 15 wherein said rear latch support engages said rear bracket whereby said rear bracket may be non-rotatably mounted on said binding at a position of existing mounting holes preformed in said binding.

17. The arrangement defined in claim 15 wherein said binding is formed with mounting brackets upon which said front clip and said rear clip may be directly mounted without requiring special adaptive brackets.

18. The arrangement defined in claim 15 further comprising:

a cable attached to said face and accessible to said user whereby exerting force on said cable remote from said face causes said latch to move within said latch support to a position whereby said closing lever is released from said latch.

19. The arrangement defined in claim 1 wherein said front clip further comprises:

a niche bar support;

a niche bar mounted at a position within said support to accept said niche of said closing lever; and, a plurality of mounts whereby said niche bar support may be mounted to a preselected position on said binding.

* * * * *